US005146505A

United States Patent [19]

Pfaff et al.

[11] Patent Number: 5,146,505

[45] Date of Patent: Sep. 8, 1992

[54] METHOD FOR ACTIVELY ATTENUATING ENGINE GENERATED NOISE

[75] Inventors: Donald P. Pfaff, Mount Clemens; Nick S. Kapsokavathis, Rochester; Natalie A. Parks, Utica, all of Mich.

[73] Assignee: General Motors Corporation, Detroit, Mich.

[21] Appl. No.: 594,495

[22] Filed: Oct. 4, 1990

[51] Int. Cl.[5] ..... G10K 11/16

[52] U.S. Cl. ..... 381/71; 381/94; 381/86

[58] Field of Search ..... 381/71, 94, 86

[56] References Cited

U.S. PATENT DOCUMENTS

| | | | |
|---|---|---|---|
| 4,153,815 | 5/1979 | Chaplin et al. . | |
| 4,417,098 | 11/1983 | Chaplin et al. . | |
| 4,506,380 | 3/1985 | Matsui . | |
| 4,878,188 | 10/1989 | Ziegler, Jr. . | |
| 5,010,576 | 4/1991 | Hill | 381/71 |
| 5,022,082 | 6/1991 | Eriksson et al. | 381/71 |

FOREIGN PATENT DOCUMENTS

| | | | |
|---|---|---|---|
| 0074399 | 4/1988 | Japan | 381/71 |

*Primary Examiner*—Jin F. Ng
*Assistant Examiner*—Nina Tong
*Attorney, Agent, or Firm*—Jimmy L. Funke

[57] ABSTRACT

A method is described for attenuating the amplitudes of multiple harmonic noise components contained within noise generated by an internal combustion engine, based upon the rotation of the engine in its operating cycle. A signal representing selected multiple harmonic noise components is generated from a table of values, based upon the engine rotation. This signal is adaptively filtered to produce a canceling waveform, which is superimposed with the engine noise to attenuate the selected multiple noise harmonics. The method is useful for selecting and attenuating dominant noise harmonics produced at different engine speeds or by different types of engines, and the dominant harmonics of different forms of noise produced by the same engine.

3 Claims, 3 Drawing Sheets

METHOD FOR ACTIVELY ATTENUATING ENGINE GENERATED NOISE

BACKGROUND OF THE INVENTION

This invention relates to the active control of noise generated by an internal combustion engine, and more particularly, to a method of selectively attenuating the amplitudes of multiple harmonic components contained in engine generated noise, based upon the angular rotation of the engine within the operating cycle.

Conventional active noise control systems attenuate undesirable noise, in the form of acoustic waves or mechanical vibrations propagating from a noise source, by producing and superimposing noise canceling waves or vibrations, which are substantially equal in amplitude and frequency content, but shifted 180 degrees in phase with respect to the noise. Recently, this has been achieved through the use of modern digital signal processing and adaptive filtering techniques. Typically, an input sensor, such as a microphone or accelerometer, is used to measure the noise generated by the source, and to develop an input signal for an adaptive filter. This input is transformed by the adaptive filter into an output signal, which drives a speaker or actuator to produce canceling waves or vibrations. An error sensor is employed to measure the observed noise level resulting from the superposition of the original noise and the canceling waves or vibrations, and develops an associated error feedback signal. This feedback signal provides the basis for modifying the parameters of the adaptive filter to minimize the level of the observed noise.

In the past, such systems have been successfully applied to attenuate noise propagating down heating and air ventilating ducts. In these applications, the input sensor is placed upstream in the duct, followed by the cancellation actuator, with the error sensor positioned further downstream. The presence of a feedback path between the input sensor and the cancellation actuator in this type of system requires the use of a recursive type adaptive filter to model the acoustic channel and provide system stability. Although these systems are capable of canceling both repetitive and random noise components, the necessity of a recursive adaptive filtering algorithm, as opposed to the non-recursive type, requires significantly more digital memory and processing time due to the increased computational complexity.

The acoustic and vibrational noise generated by an internal combustion engine differ significantly from that found in heating and air ventilating ducts. The amplitude of engine generated noise can vary quite rapidly with abrupt changes in engine loading, as for example, when the engine is quickly accelerated or decelerated. In addition, engine generated noise is dominated by harmonically related components having frequencies which vary as a function of the engine rotational speed. Also, engines having differing numbers of cylinders generate noise characterized by different dominant harmonic components, due to the different firing frequencies. Finally, acoustic and vibrational noise generated by an engine have different harmonic content, depending upon whether the source of the noise is the air intake system, the exhaust system, or mechanical vibrations produced by operation of the engine.

Consequently, a need exists for a convenient method of selectively attenuating the amplitudes of multiple harmonic noise components generated by internal combustion engines.

SUMMARY OF THE INVENTION

In accord with this invention, a method is provided for selectively attenuating the amplitudes of multiple harmonic components contained in noise generated by an internal combustion engine during its operation cycle, where the frequencies of the harmonic components are functionally related to the rotational speed of the engine. This is accomplished by deriving an indication of the angular rotation of the engine within the operating cycle; generating a signal to represent the multiple harmonic noise components selected for attenuation, based upon the derived indication of the engine angular rotation; and attenuating the noise generated by the engine in accordance with the signal representing the selected multiple harmonic engine noise components. As a result, the invention affords a convenient and flexible method for attenuating different dominant harmonic components produced by different types of engines, and from dissimilar noise sources on the same engine. Consequently, an active noise control system employing the present invention can be customized to meet the needs of the particular application, since system electrical power requirements, the cancellation actuator size, and system frequency response are directly related to the number and order of the harmonics selected for attenuation.

According to one aspect of the invention, the signal representing the selected multiple harmonic noise components is generated from a predetermined schedule of values, based upon the angular rotation of the engine in the operating cycle. The values in the schedule are determined by computing the sum of sinusoidal terms associated with the selected multiple harmonic noise components. The arguments of the sinusoidal terms are functions of integer multiples of the angular position of the engine in its operating cycle. Thus, the generated signal is automatically synchronized to the rotation of the engine, to assure correspondence between the frequencies of components contained within the generated signal and the noise harmonics produced by the engine.

In another aspect of the invention, different schedules of values may be used when generating the signal representing selected multiple noise harmonics, with each schedule corresponding to a specified range of engine speed. Values for each schedule can then be determined to correspond to the dominant harmonic noise components produced by the engine, when it operates within the specified range of speeds. Thus, the present invention may be employed to effectuate the attenuation of engine noise, which contains different order dominant harmonics, depending upon the operating speed of engine.

As contemplated by another aspect of the invention, engine noise is attenuated by developing a noise canceling waveform, and superimposing it with the engine noise to be attenuated. The noise canceling waveform has substantially the same amplitude and frequency content as the noise to be attenuated, but is shifted in phase by 180 degrees. In one embodiment, the canceling waveform is developed by adaptively filtering the signal generated to represent selected multiple harmonic noise components. In another embodiment, the signal generated to represent the multiple noise harmonics is amplitude modulated, as a function of engine loading, prior to being adaptively filtered to develop the canceling waveform. As a consequence, the active noise control system is capable of responding more rapidly to changes in the engine noise level caused by abrupt changes in engine loading.

In both of the above embodiments, the conventional input noise measuring sensor and its associated circuitry are displaced by the signal representing the multiple noise harmonics. As a consequence, the feedback path between the cancellation actuator and input sensor is eliminated, along with the necessity of a recursive adaptive filtering algorithm. Thus, an important advantage is that non-recursive adaptive digital filtering algorithms, such as the Filtered X Least Mean Squares (LMS) type, can be employed when practicing the present invention. Not only are these non-recursive digital algorithms inherently more stable than the recursive kinds, they are computationally less complex, and require less memory and processing time to execute.

According to yet another aspect of the invention, engine noise generated from various sources, such as acoustic noise from the exhaust system or air intake system, and vibration noise produced by operation of the engine, can be attenuated based upon the same measurement of engine rotation in the operating cycle. This is accomplished by utilizing separate schedules, and generating a different signal for each source of noise, such that each signal represents the harmonic components produced by the particular source of noise. Consequently, the present invention dispenses with the requirement of distinct input sensors and circuitry for measuring the noise from each source, as would be the case in the conventional active noise control systems described previously.

These and other aspects and advantages of the invention may be best understood by reference to the following detailed description of the preferred embodiments when considered in conjunction with the accompanying drawings.

DESCRIPTION OF THE PREFERRED EMBODIMENTS

Figure 1:
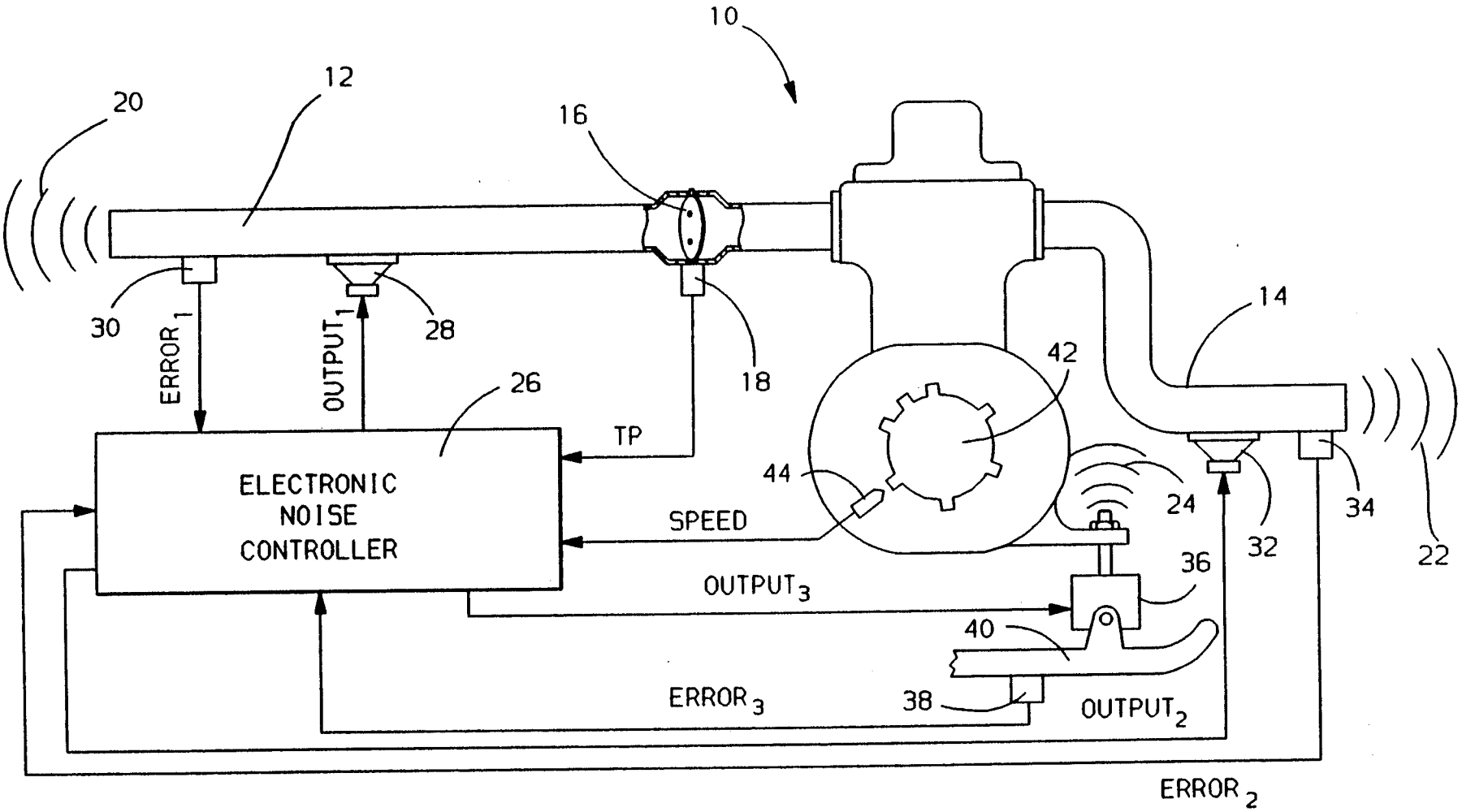
FIG. 1 is a schematic diagram of an active noise control system employed to attenuate engine generated noise in accordance with the principles of the present invention.

Referring to FIG. 1, there is shown schematically an internal combustion engine, generally designated as 10, with its associated air intake system 12 and exhaust system 14. A rotatable throttle valve 16 is included within the air intake system 12 for regulating air flow to the engine 10. Also shown are two sensors generally associated with the electronic control of engine performance. The first is a standard throttle position sensor 18, such as a potentiometer, which is connected to throttle valve 16 and develops an electrical signal TP related to the degree or percent of throttle valve opening. The second is a conventional engine rotational sensor, which includes a toothed wheel 42 mounted on the engine crankshaft, and an electromagnetic sensor 44 that produces a SPEED signal having pulses corresponding to the movement of teeth on wheel 42 past electromagnetic sensor 44. The particular toothed wheel 42, shown in FIG. 1, has six symmetrically spaced teeth producing equally spaced pulses in the engine SPEED signal, and a seventh asymmetrically spaced tooth that produces a synchronization pulse typically used for determining engine rotation from a known reference position.

During the operation of engine 10, acoustic pressure waves are generated and propagate away from the engine through the ducts and tubes forming the air intake and exhaust systems. Eventually, these pressure waves propagate from openings in the intake and exhaust systems as observable engine induction noise 20 and exhaust noise 22. In addition, the engine generates noise in the form of mechanical vibrations 24, which are ultimately transferred to a mounting frame 40 used to support engine 10.

Conventional active noise control systems attenuate undesirable random and repetitive noise by producing and superimposing noise canceling waves or vibrations, which are substantially equal in amplitude and frequency content, but shifted 180 degrees in phase with respect to the noise. Modernly, this is accomplished with the use of digital signal processing and adaptive filtering techniques. Traditionally, an input sensor, such as a microphone or accelerometer, is used to measure the noise generated by the source, and to develop an input signal for an adaptive filter. This input is transformed by the adaptive filter into a canceling output signal, which drives a speaker or actuator to produce canceling waves or vibrations. An error sensor is employed to measure the observed noise level resulting from the superposition of the original noise and the canceling waves or vibrations, and develops an associated error feedback signal. This feedback signal provides the basis for modifying the parameters of the adaptive filter to minimize the level of the observed noise.

In the past, such systems have been successfully applied to attenuate noise propagating down heating and air ventilating ducts. In these applications, the input sensor is placed upstream in the duct, followed by the cancellation actuator, with the error sensor positioned further downstream. The presence of a feedback path between the input sensor and the cancellation actuator in this type of system requires the use of a recursive type adaptive filter to model the acoustic channel and provide system stability. Although these systems are capable of canceling both repetitive and random noise components, the necessity of a recursive adaptive filtering algorithm, as opposed to the non-recursive type, requires significantly more digital memory and processing time due to the increased computational complexity.

The acoustic and vibrational noise generated by the internal combustion engine 10 differ significantly from that found in heating and air ventilating ducts. The amplitude of engine generated noise can vary quite rapidly with abrupt changes in engine loading, as for example, when the engine is quickly accelerated or decelerated. In addition, engine generated noise is dominated by harmonically related components having frequencies which vary as a function of the engine rotational speed. Thus, engines having differing numbers of cylinders generate noise characterized by different dominant harmonic components, due to the different firing frequencies. Also, the forms of acoustic and vibrational noise generated by an engine have different harmonic content, depending upon whether the source of the noise is the air intake system, the exhaust system, or engine operation producing mechanical vibrations.

The present invention is directed toward providing a convenient method for selectively attenuating the amplitudes of multiple harmonic noise components generated by engine 10, and also, eliminating the necessity of the conventional input microphone, so that a more efficient non-recursive type adaptive filtering algorithm can be employed. As described hereinafter, this is accomplished by deriving an indication of the angular rotation of the engine in its operating cycle; generating a signal to represent the multiple harmonic engine noise components selected for attenuation, based upon the derived indication of the engine angular rotation; and then attenuating the engine generated noise in accordance with the signal representing the selected multiple harmonic engine noise components.

Further illustrated in FIG. 1 are components of an active noise control system used for attenuating induction, exhaust, and vibrational noise generated by engine 10, in accord with the principles of the present invention. Electronic noise controller 26 is a multi-channel device having three separate channels, with each channel operating independently to attenuate one of the different forms of engine noise.

Conventionally, each channel of noise controller 26 would require a separate input sensor for deriving a signal representative of the noise to be canceled by that channel. However, with the present invention, individual input sensors are not required, since the input signals for each channel can be generated based upon the engine rotational SPEED signal, as will be described subsequently.

As depicted in FIG. 1, one channel of the noise controller 26 is utilized to attenuate the engine generated induction noise propagating inside the air intake system 12. Based upon an input signal associated with the engine induction noise, a canceling $OUTPUT_1$ signal is produced by noise controller 26. This $OUTPUT_1$ signal drives a speaker 28, or any other type of suitable actuator capable of generating canceling acoustic waves for superposition with the engine induction noise. An error microphone 30, or any other suitable acoustic sensor, is employed to measure the level of the attenuated induction noise remaining in the air intake system 12, after the superposition of the canceling acoustic waves, and to develop a corresponding analog $ERROR_1$ feedback signal. This $ERROR_1$ signal is directed back to the induction noise channel of the electronic noise controller 26, and provides the basis for minimizing the observed induction noise 20 propagating out of engine 10.

In using a second channel of the noise controller 26 to cancel exhaust noise, the operations described above are duplicated, except that a noise canceling $OUTPUT_2$ signal is produced to drive the exhaust actuator or speaker 32, and an $ERROR_2$ signal is developed by microphone 34 to act as feedback for the exhaust noise channel of noise controller 26.

Similarly, in canceling engine generated vibrational noise 24, a third channel of the noise controller 26 produces noise canceling signal $OUTPUT_3$ to drive an electromagnetic shaker 36, which is disposed between engine 10 and mounting frame 40. Electromagnetic shaker 36 may be any type of actuator known to those skilled in the art of active noise control, as for example, a commercially available Model 203B Shaker supplied by Ling Electronics, Inc., which is capable of producing the required out-of-phase canceling vibrations. Also, an error feedback signal $ERROR_3$ representing the residual vibrations transferred to mounting frame 40 is developed by an error sensor 38, such as an accelerometer, which is attached to the mounting frame 40.

The electronic noise controller 26 preferably includes a standard digital signal processor with the necessary interfacing circuitry such as analog amplifiers and filters, analog-to-digital and digital-to-analog converters, frequency multipliers, counters, clocks, and other known input/output signal conditioning circuitry. The amplitudes of the various analog signals directed to the noise controller 26 are sampled at a fixed sampling rate and sets of these sample values are retained for use in computing digital output signals using the adaptive filtering algorithms of the separate channels. The digital output signals are then converted to analog form and appropriately amplified to provide the signals necessary for driving the system cancellation actuators. The actual hardware implementation of noise controller 26 is not described herein, since such circuitry is well known in the art and is described in numerous publications and texts, see for example, "Hardware and Software Considerations for Active Noise Control", M. C. Allie, C. D. Bremigan, L. J. Eriksson, and R. A. Grainier, 1988, IEEE, CH 2561-9/88/0000-2598, pp. 2598-2601.

Digital signal processors are commercially available, for example the Motorola 56000, and typically contain a central processing unit for carrying out instructions and arithmetic operations, random access memory for storing data, and read only memory for permanently storing program instruction. When utilized for active noise control, the digital signal processor is typically programmed to function as a single adaptive digital filter. In the above described application, the digital signal processor is programmed to function as a multi-channel device, with each channel having a separate adaptive filter.

The method used in generating the input signals for different channels of the noise controller 26 will now be described. In the preferred embodiments of the invention, an indication of the angular rotation of the engine is derived from the engine SPEED signal produced by the engine rotational sensor described previously, however, any other known means for sensing engine rotation could also be employed.

Figure 2:
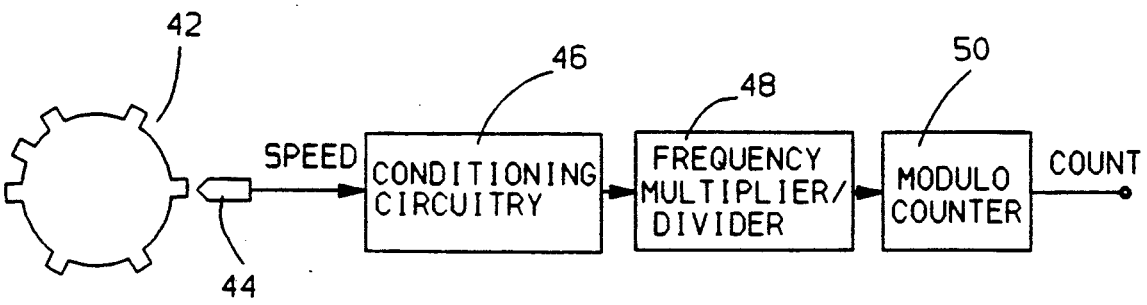
FIG. 2 is a block diagram representing the electronic components, within the noise controller of FIG. 1, used for deriving an indication of angular rotation of the engine in the operating cycle.

The block diagram shown in FIG. 2 represents circuitry within noise controller 26 used to process the engine SPEED signal. The SPEED signal, which contains pulses generated by the movement of toothed wheel 42 past electromagnetic sensor 44, is passed to the conditioning circuitry 46, where the asymmetrical synchronization pulse is eliminated and the remaining symmetrical pulses are shaped to be compatible with the digital format of the noise controller 26. These formatted digital pulses representing crankshaft angular rotation are then passed to a standard frequency multiplier/divider, which generates a fixed number of pulses during one complete rotation of the engine crankshaft. These pulses are then counted by a conventional module counter, to provide an output COUNT signal, which is indicative of the rotational position of the crankshaft in the engine cycle at any given time.

In general, the number of teeth on wheel 42, the frequency multiplier/divider, and the modulo counter are selected to provide an integer count ranging in value from 0, to a maximum value of MAX, each time the engine completes a cycle. A complete cycle in a four-stroke engine being two full revolutions of the engine crankshaft. The value of COUNT then represents a derived indication of the angular rotation of the engine in the operating cycle as required by the present invention. Based upon the value of COUNT, the noise controller 26 is able to generate a separate input signal for each channel representing the multiple harmonic components selected for attenuation in noise associated with that particular channel.

To avoid unnecessary duplication in the specification, in what follows only a single channel of noise controller 26 will be described using generalized terms for the channel signals, such as OUTPUT and ERROR, without reference to the subscripted terms shown in FIG. 1. It should then be understood that this description will be equally applicable to any of the individual channels of the noise controller 26.

Figure 3:
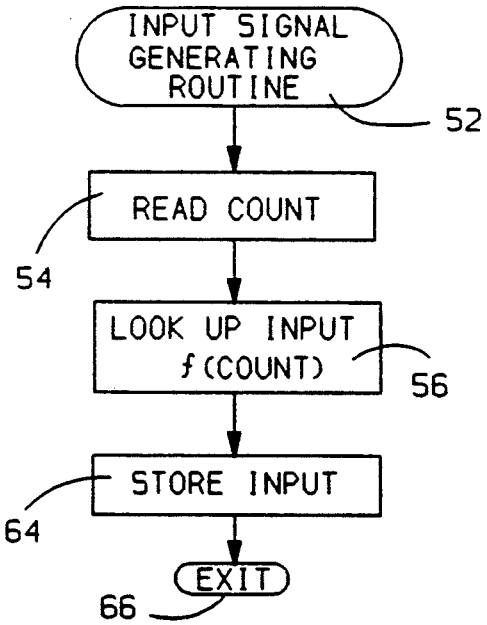
FIG. 3 is a flow diagram representative of the instructions in a routine executed by the noise controller of FIG. 1, in generating a signal representative of multiple harmonic components contained within generated noise.

Referring now to FIG. 3, there is shown a flow diagram representative of the program steps that would be executed by electronic noise controller 26 in one embodiment of the present invention, in generating a channel input signal representing multiple harmonic components selected for attenuation. The Input Signal Generating Routine is entered at point 52, after each system interrupt associated with the sampling rate of the digital signal processor contained within electronic noise controller 26. The program then proceeds to step 54, where the current COUNT of the previously described modulo counter is read and stored. As described later, it may also be desirable at this step to establish a value for RPM, the rotational speed of the engine. This may be accomplished, for example, by storing consecutive values of COUNT at specified times established by an interval timer, and then subtracting these stored values to obtain the angular rotation of the engine during the timer interval. The current value representing RPM can then be determined by multiplying the resulting angular rotation of the engine by a fixed scaling constant to convert to revolutions per minute.

Next at step 56, INPUT, a sample value for the input signal representing multiple harmonic noise components selected for attenuation, is looked up in an INPUT table containing a schedule of values that vary as a function of the COUNT found in the previous step 54. Stored values the INPUT table schedule are computed according to the following general equation:

$$INPUT = A\ sin(q*COUNT) + B\ sin(2*q*COUNT) + C\ sin(3*q*COUNT) + \ldots + M\ sin(m*q*COUNT, \quad (1)$$

where, A, B, C, . . . , and M represent the amplitudes of the harmonic components used in approximating the engine noise; q is a conversion constant given by $q = 2\pi/(MAX+1)$; and the integer m represents the order of the largest harmonic related to engine rotational speed that is of interest.

For the purpose of computing values for the INPUT table, a form of noise produced by a given engine is measured to determine the order of the dominant harmonic components present within the noise. Next, the amplitudes A, B, C, . . . , and M of the harmonic components in the above equation, which are selected to be attenuated in the engine noise, are set equal to unity, and the amplitudes of those not selected for attenuation are set to zero. Then, table values for INPUT are computed for each possible integer value of COUNT, using the equation presented above. Prior to storage in the table, all of the calculated INPUT values are normalized to range between −1 and 1, by dividing each by the maximum magnitude found for the table INPUT values. Alternatively, relative values for the amplitudes A, B, C, . . . , and M of the selected noise harmonics could be found by measuring the noise to be attenuated and determining an average amplitude value for each harmonic component, while running the engine on a dynamometer at different speeds over the operating range of the engine.

In applications where different order noise harmonics are dominant at different engine operating speeds, the INPUT table can contain different schedules for different ranges of engine operating speed. The values for each separate schedule can then be computed, as described above, to correspond to the dominant noise harmonics produced by the engine, when it operates within the associated range of engine speed For this particular embodiment of the invention, the current engine speed, as represented by the value of RPM derived in step 54, is used to select the appropriate INPUT table schedule, from which a sample for the input signal is looked up, based upon the current value of COUNT. Thus, the present invention provides a convenient and flexible technique for selecting which engine noise harmonics are to be attenuated by the active noise control system for a particular form of noise and engine type. This technique also enables the active noise control system to be customized to meet the needs of the particular application, since system electrical power requirements, the cancellation actuator size, and system frequency response are directly related to the number and order of the harmonics selected for attenuation.

From step 56 the program proceeds to step 64, where the value for INPUT is stored in memory as INPUT(n), which represents the most recently generated sample value for the INPUT signal. Prior to storing this new value for INPUT(n), the previous value is shifted and stored in memory as INPUT(n−1), and so forth as down to the last retained sample in the sequence INPUT(n-N+1), where N represents the number of sequential sample values of the INPUT signal retained in memory for later use by the noise controller 26.

Then at step 66, the routine is exited with the sequence of generated INPUT samples acting as a channel input signal representing the multiple harmonic noise components selected for attenuation by that channel of the noise controller 26. Because the generation of the input signal is based upon current value of COUNT from the modulo counter, the input signal is automatically synchronized to the rotation of the engine, which assures correspondence between the frequencies of components contained within the generated signal and the noise harmonics produced by the engine.

As described in U.S. Patent Application Ser. No. 07/565,395, filed Aug. 10, 1990, which is co-pending with the present application and assigned to the same assignee, the response of an active noise control systems to abrupt changes in engine loading can be improved, if the amplitude of the input signal representing the noise to be attenuated is modulated as a function of the load on the engine. Thus, in another embodiment of the present invention, the amplitude of the input signal generated to represent the multiple engine noise harmonics is modulated as a function of engine loading. Preferably an indication of engine loading is derived by measuring the position of the intake throttle valve 16 (see FIG. 1), it should be understood that other measures of engine loading could be used, such as intake manifold vacuum or engine mass air flow.

Figure 4:
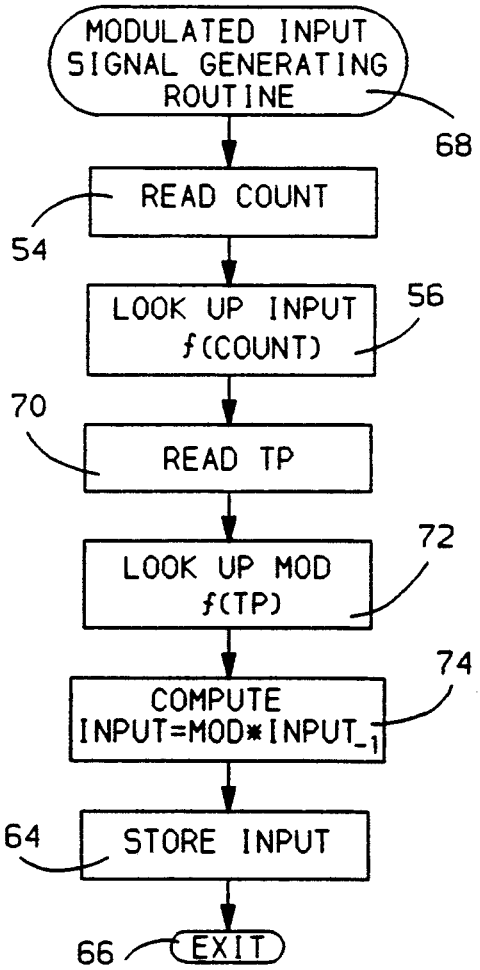
FIG. 4 a flow diagram representative of the instructions in a routine executed by the noise controller of FIG. 1, in generating a signal representative of multiple harmonic components contained within engine noise, where the amplitude of the signal is modulated as a function of engine loading.

Referring now to FIG. 4, there is shown a flow diagram representing the program steps that are executed by noise controller 26, when generating a channel input signal that has its amplitude modulated as a function of engine loading. Note that identical steps in the flow diagrams of FIGS. 3 and 4 have been designated with the same numerals.

The Modulated Input Signal Generating Routine is entered at step 68 and proceeds through the same steps 54 and 56, previously described in conjunction with FIG. 3, to look up a sample value for INPUT.

Next at step 70, noise controller 26 reads the current position of the throttle valve by sampling the value of the analog throttle position signal TP. This value for TP is stored, and the program then proceeds to step 72.

At step 72, a value for MOD, the modulation factor, is looked up in a stored schedule, as a function of the current position of the throttle found in step 70. The schedule values for the modulation factor MOD will be dependent both upon the form of the noise and the type of engine producing it. Values for the MOD table can be determined by measuring the particular form of noise to be attenuated, while operating an engine on a dynamometer. The value representing MOD for each position of the throttle are found by determining the average level of noise produced, while varying engine speed with the throttle position fixed . All such measured average values are normalized prior to storage in the MOD schedule, by dividing each average value by the maximum average value found during testing. In this way, the stored values in the MOD schedule are scaled to range between 0 and 1.

Next at step 74, a new amplitude modulated value for INPUT is computed by multiplying $INPUT_{-1}$, the value of INPUT found at step 56, by the modulation factor MOD found at step 72.

Then as in FIG. 3, the routine proceeds to step 64, where the current value for INPUT is stored in memory as INPUT(n), which represents the most recently generated sample value for the amplitude modulated INPUT signal. As previously described, prior to storing this new value for INPUT(n), the previous value is shifted and stored in memory as INPUT(n−1), and so forth as down to the last retained sample in the sequence INPUT(n-N+1).

The routine is exited as step 66, with the sequence of generated INPUT samples representing a channel input signal, which has its amplitude modulated as a function of engine loading.

A sequence of sample values representing the input signal for a particular channel of the noise controller 26 can then be derived using either of the routines presented in FIGS. 3 and 4. A corresponding sequence of sample values ERROR(n), ERROR(n−1), . . . , ERROR(n-N+1), is obtained for each channel by sampling each channel's analog error signal at the system sampling rate, and then storing these values in the memory of the noise controller 26. Using these sample values for the channel input and error signals, noise controller 26 computes a sample value OUTPUT(n) for the channel output signal using an adaptive filtering algorithm. The noise controller 26 converts the consecutively computed digital samples OUTPUT(n) into an analog waveform, which is then amplified to produce the OUTPUT canceling signal used to drive the channel's cancellation actuator.

As previously indicated, one of the advantages associated with the present invention is the elimination of the need for separate channel input sensors for measuring each form of engine noise to be attenuated by the separate channels of the noise controller 26. As a consequence, the conventional feedback path between the traditional input sensor and the cancellation actuator is eliminated, and non-recursive type adaptive filtering algorithms can then be used to compute the channel OUTPUT(n) samples. Not only are these non-recursive digital algorithms inherently more stable than the recursive types, they are computationally less complex, and require less memory and processing time to execute.

Figure 5:
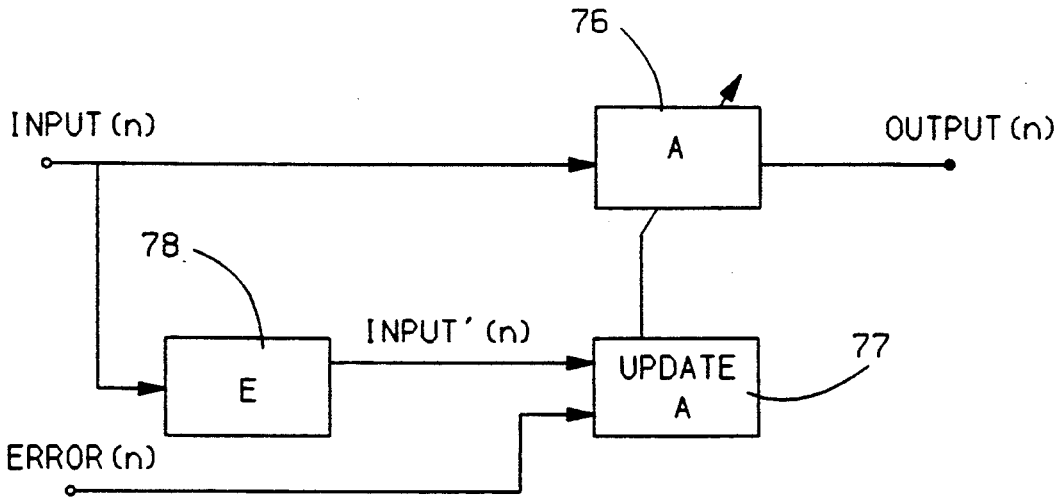
FIG. 5 is a schematic diagram of a Filtered X Least Mean Squares (L) adaptive model utilized in the preferred embodiment of the present invention.

Referring now to FIG. 5, there is shown a schematic diagram for a Filtered X Least Mean Squares (LMS) adaptive filter, which is the type of non-recursive filtering algorithm utilized for the preferred embodiments of the present invention. Only a brief explanation of the operation of this particular type of adaptive filter will be provided here, as a detailed description can be found in the text book *Adaptive Signal Processing,* B. Widrow and S. Sterns, Englewood Cliffs, New Jersey, Prentice-Hall, Inc., 1985, pp. 288–294. Although each channel of the noise controller 26 has a separate adaptive filter, only one such filter is described below, since the description is applicable to each channel.

Consecutive sample values for a channel OUTPUT(n) signal are produced at the system sampling rate, by adaptively filtering the most recent INPUT(n) sample, and the other retained samples in the INPUT sequence, using the non-recursive digital A filter 76. New sample values for OUTPUT(n) are computed in accordance with the following algorithm:

$$\mathrm{OUTPUT}(n) = \sum_{i=0}^{N-1} A_i(n) * \mathrm{INPUT}(n-i), \tag{2}$$

where the set of $A_i(n)$ represent the most recently computed adaptive filter coefficients for the A filter, and N represents the size of the filter, as well as the number of samples of generated input signal retained in memory.

After a new sample value is computed for OUTPUT(n), the adaptive filter coefficients $A_i(n)$ are updated as indicated by the UPDATE A block 77 in the diagram, in order to minimize the ERROR(n) sample values, which represent the residual engine noise remaining after the superposition of the canceling noise waveform. The UPDATE A block 77 has two inputs, the first being ERROR(n), and the second being a filtered sequence of sample values designated as IN- PUT'(n) derived by passing the corresponding sequence of input signal samples INPUT(n) through the auxiliary E filter 78. The algorithm for updating each of the adaptive filter weights $A_i(n)$ to $A_i(n+1)$, for the next sampling interval is given by:

$$A_i(n+1)=g*A_i(n)-u*ERROR(n)*\text{INPUT}'(n-i), \quad (3)$$

where g represents the filter leakage coefficient having a value in the range of $0 << g < 1$, and u represents the filter convergence factor having a value in the range of $0 < u << 1$. For the present invention the preferred values for g and u were $g = 0.999$ and $u = 0.03$.

The sequence of sample values for the INPUT'(n) signal in equation (3) are obtained by filtering the sequence of INPUT(n) values with the auxiliary E filter 78 according to the following equation:

$$\text{INPUT}'(n) = \sum_{i=0}^{N-1} E_i(n) * \text{INPUT}(n-i), \quad (4)$$

where the $E_i(n)$ represent the fixed weighting coefficients for the auxiliary E filter. As described in "An Analysis of Multiple Correlation Cancellation Loops with a Filter in the Auxiliary Path", D. R. Morgan, IEEE Transactions on Acoustic Speech Speech Signal Processing, Vol. ASSP-28, No. 4, 1980, pp.454–467, the auxiliary E filter 78 is used to compensate for the distortion produced by components in the channel error path of the active noise control system. This error path typically includes the channel cancellation actuator and the associated output circuitry within noise controller 26; the error sensor and the associated error input circuitry within noise controller 26; and the characteristics of the physical path between the channel cancellation actuator and error sensor, over which the engine noise propagates.

Figure 6:
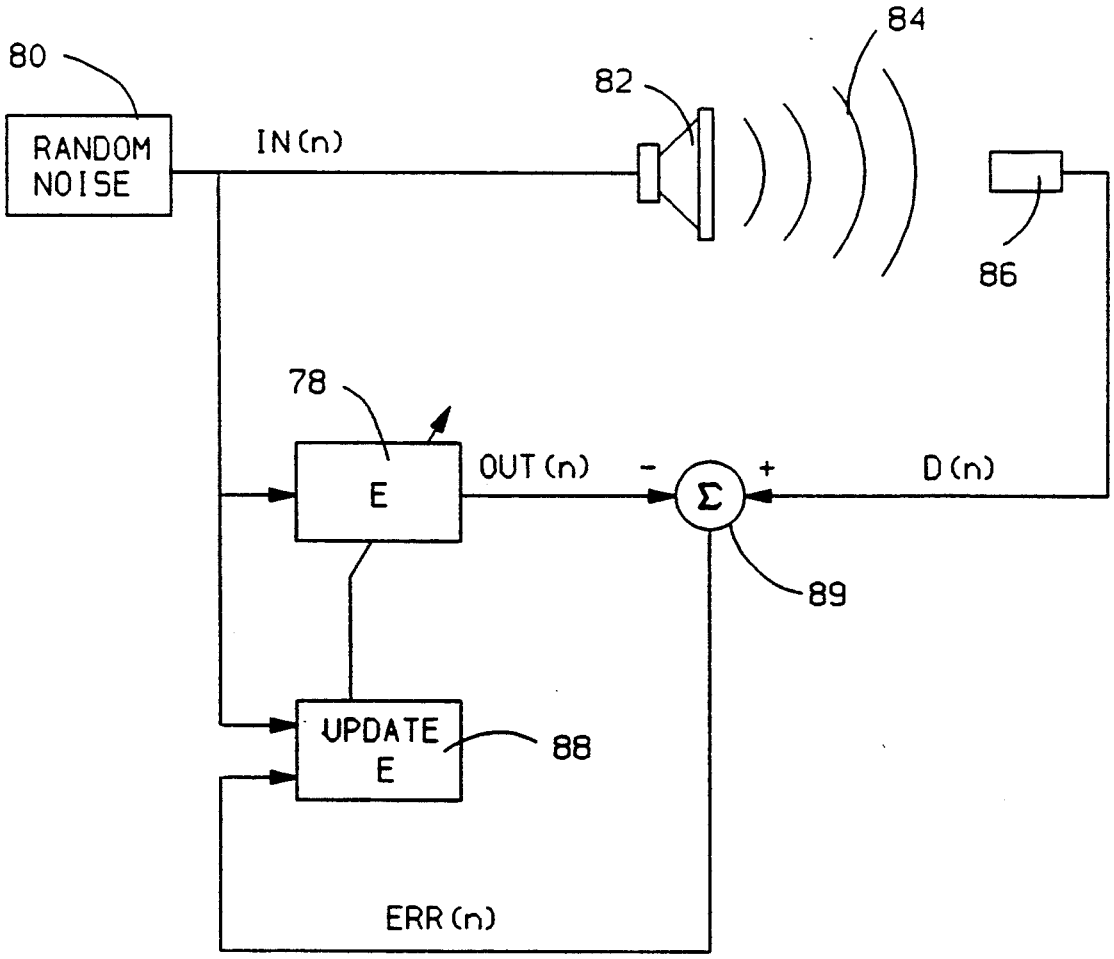
FIG. 6 a schematic diagram representing the off-line training process for the auxiliary filter E of the adaptive model illustrated in FIG. 5.

Referring now to FIG. 6, there is shown a schematic diagram representing the process used in off-line training a channel auxiliary E filter 78, to obtain its fixed weighting coefficients. In this process, the auxiliary E filter is trained to have a transfer function equivalent to the combined components in the channel error path. When training an E filter for a particular channel of the noise controller 26, the components in the error path, such as the cancellation actuator 82, noise propagation path 84, and error sensor 86, must remain in the same physical locations, as when they are used in attenuating the engine noise associated with that channel.

The training process uses a conventional RANDOM NOISE SOURCE 80 to generate a sequence of random signal values designated as IN(n). The random signal samples are directed as input to the auxiliary E filter 78, and are also passed through the components of the error path to produce a corresponding sequence of samples designated as D(n). In passing over the error path, the IN(n) sample are subjected to the same components as are the OUTPUT(n) samples and the resulting ERROR(n) samples of FIG. 5.

For the training configuration shown in FIG. 6, the algorithms associated with the digital E filter 8, and its adaptation by the UPDATE E block 88, are given by:

$$\text{OUT}(n) = \sum_{i=0}^{N-1} E_i(n) * \text{IN}(n-i), \text{ and} \quad (5)$$

$$E_i(n+1) = g * E_i(n) + u * ERR(n) * \text{IN}(n-i), \quad (6)$$

where, OUT(n) represents sample values output by the digital E filter 78, and the ERR(n) samples are produced as output from summer 89 and are given by:

$$ERR(n)=D(n)-OUT(n), \quad (7)$$

where D(n) represents the sample values derived from the channel error sensor 86. With this off-line training process, the the weighting coefficients of the digital E filter 78 are adaptively updated to minimize the ERR(n) values. When this adaptive modeling procedure is complete, the transfer function of the digital E filter 78 duplicates that of the combined components in the channel error path, and can be used as illustrated in FIG. 5 to compensate for the distortion introduced by components in system error path.

Although the Filtered X Least Mean Squares (LMS) adaptive filter has been described as the preferred type of non-recursive adaptive filter used in implementing the present invention, it should be understood that other types of adaptive filters, recursive as well as non-recursive, may also be used. However, the computational efficiency associated with the Filtered X Least Mean Squares (LMS) adaptive filter permits a single digital signal processor to be programmed to function as a multi-channel device so that more than one form of engine noise can be attenuated with a single noise controller.

It will be recognized by those skilled in the art that present invention can be used to attenuate a single form of engine generated noise, or several forms of engine noise simultaneously by applying the invention to each channel of a multi-channel electronic noise controller, such as illustrated in FIG. 1.

The aforementioned description of the preferred embodiments of the invention is for the purpose of illustrating the invention, and is not to be considered as limiting or restricting the invention, since many modifications may be made by the exercise of skill in the art without departing from the scope of the invention.

The embodiments of the invention in which an exclusive property or privilege is claimed are defined as follows:

1. For an internal combustion engine having an operating cycle characterized by the generation of engine noise containing harmonic components, the frequencies of which are related to engine rotational speed, a method for selectively attenuating the amplitude of multiple harmonic noise components in engine noise, the steps of the method comprising:

deriving an indication of the angular rotation of the engine in the operating cycle;

generating a signal representative of selected multiple harmonic noise components from a predetermined schedule of values as a function of the derived indication of the angular rotation of the engine in the operating cycle, with the value sin the schedule determined by summing separate sinusoidal terms, with each sinusoidal term corresponding to one of the selected multiple harmonic component and having an argument related to an integer multiple of the angular rotation of the engine in the operating cycle; and attenuating noise generated by the engine in accordance with the signal generated to represent the selected multiple harmonic noise components.

2. For an internal combustion engine having an operating cycle characterized by the generation of engine noise containing harmonic components, the frequencies of which are related to engine rotational speed, a method for selectively attenuating the amplitudes of multiple harmonic noise components in engine noise, the steps of the method comprising:

deriving an indication of the engine cycle position;

deriving an indication of the engine rotational speed;

generating a signal representative of selected multiple harmonic noise components from a table of values based upon the derived indications of the engine cycle position and rotational speed, the table having a plurality of separate predetermined schedules, each schedule being associated with a different range of engine rotational speed and having values determined by summing separate sinusoidal terms corresponding to the selected multiple harmonic component for the associated range of engine speed, with each sinusoidal term having an argument related to an integer multiple of the engine cycle position; and attenuating noise generated by the engine in accordance with the signal generated to represent the selected multiple harmonic noise components.

3. For an internal combustion engine having an operating cycle characterized by the generation of engine noise containing harmonic components, the frequencies of which are related to engine rotational speed, a method for selectively attenuating the amplitudes of multiple harmonic noise components in engine noise, the steps of the method comprising:

deriving an indication of the the engine cycle position;

generating a signal representative of selected multiple harmonic noise components from a predetermined schedule of values as a function of the derived indication of the engine cycle position, with the values in the schedule determined by summing separate sinusoidal terms, with each sinusoidal term corresponding to one of the selected multiple harmonic component and having an argument related to an integer multiple of the engine cycle position; and attenuating noise generated by the engine in accordance with the signal generated in represent the selected multiple harmonic noise components.

* * * * *